US006962558B2

(12) United States Patent
Dalrymple

(10) Patent No.: US 6,962,558 B2
(45) Date of Patent: Nov. 8, 2005

(54) METHOD OF FORMING BOX WITH GUSSETED CORNER

(76) Inventor: Bruce H. Dalrymple, 5380 Emmett Still Rd. SW., Loganville, GA (US) 30052

( * ) Notice: Subject to any disclaimer, the term of this patent is extended or adjusted under 35 U.S.C. 154(b) by 0 days.

(21) Appl. No.: 10/781,093

(22) Filed: Feb. 17, 2004

(65) Prior Publication Data

US 2004/0171468 A1 Sep. 2, 2004

Related U.S. Application Data

(63) Continuation of application No. 10/264,652, filed on Oct. 5, 2002, now abandoned.
(60) Provisional application No. 60/327,523, filed on Oct. 5, 2001.

(51) Int. Cl.[7] ..... B31B 1/78
(52) U.S. Cl. ..... 493/309; 493/128; 493/183
(58) Field of Search ..... 493/51, 128, 141, 493/166, 178, 179, 183, 309

(56) References Cited

U.S. PATENT DOCUMENTS 1,653,116 A * 12/1927 Parks ..... 229/191
2,308,010 A * 1/1943 Horowitz ..... 53/377.2
3,927,505 A * 12/1975 Bemiss ..... 53/456
4,163,414 A * 8/1979 Bachman et al. ..... 493/181
5,452,848 A * 9/1995 Mur Gimeno ..... 229/191
6,226,965 B1 * 5/2001 Lam ..... 53/491

FOREIGN PATENT DOCUMENTS

GB 2220406 A * 1/1990 ..... B65D/5/42

* cited by examiner

*Primary Examiner*—John Paradiso
(74) *Attorney, Agent, or Firm*—Adam H. Jacobs

(57) ABSTRACT

A method of forming a box having a plurality of corner gussets includes the steps of providing a generally planar box blank and a box forming device including a gusset formation section having a kicker plate, a forming blade and an adhesive securement device. The box blank is fed into the box forming device, the kicker plate deflects each of the gusset corner formation wall sections upwards, the upper portion thereof is bent towards a side wall via the forming blade and the glue flap section is secured to the side wall via the adhesive securement device to form a gusset, and the box is formed by folding the side walls upwards generally perpendicular to the base wall and securing adjacent ones of the side walls to one another whereby the box is formed. A box formed via the above-described method is also claimed.

6 Claims, 4 Drawing Sheets

METHOD OF FORMING BOX WITH GUSSETED CORNER

CROSS-REFERENCE TO RELATED UTILITY AND PROVISIONAL PATENTS

This continuation application claims priority based on previously filed provisional and utility patents, specifically on the provisional patent application Ser. No. 60/327,523 filed Oct. 5, 2001 and to utility patent application Ser. No. 10/264,652 filed Oct. 5, 2002, now abandoned.

BACKGROUND OF THE INVENTION

1. Technical Field

The present invention relates to boxes having reinforced corner structures and, more particularly, to a generally rectangular box having gusseted corner construction and a method of forming the same in which the box is formed from a single blank on which the gusset corners are formed, the box then being assembled to provide for storage of materials therein and a method of forming the same which includes construction of the gusseted corners prior to assembly of the box.

2. Description of the Prior Art

In the field of paper box design and construction, there are several different design and construction elements which affect the strength and cost of the box. Among these are the type and thickness of paper product used in the construction of the box, the design of the box in unassembled and assembled positions and the wall and corner construction of the assembled box. Each of these factors is important in constructing an efficient and economical box for the following reasons.

Regarding the paper product used in the construction of the box, it has been found that even a small reduction in wall thickness will produce a large cost savings to the box purchaser, and therefore it is desirable to use the thinnest possible construction materials in the construction of the box. Of course, however, a wall which is too thin will not permit stacking of assembled boxes atop one another or can provide insufficient protection for the contents of the box, which is undesirable. The box manufacturer thus has two options, to make the wall thickness greater or to provide reinforcement for the walls, particularly the corners, of the assembled box. As the increased thickness is not a viable option, it then becomes imperative to design a box which includes reinforced wall, particularly corner, construction.

A second concern for the box designer is to design a box which can be transported in an unassembled, generally flat position and which can be assembled by the end user as needed to package goods. The transport of pre-assembled boxes results in greatly increased shipping costs, as much of the shipping space is taken up by the interior volume of the assembled boxes. Also, the storage of preassembled boxes requires greater room, which many businesses cannot allocate without sacrificing space which is sorely needed for business operations. It is therefore seen that there is a need for a box design which can be transported in a generally flat unassembled position yet can be quickly and easily assembled by the end user for packaging needs.

Yet another concern for the box designer is directly related to the use of the box by the end user, and that is the nature of the corner construction of the box. As was stated previously, the strength of the box is dependent on the wall thickness and corner construction of the box, and thinner wall construction is desirable to reduce shipping weight and construction costs, thereby increasing the profitability of the box. To maintain the structural strength of the box, then, the corners of the box must be constructed to support not only the weight of the box itself, but also the weight of boxes and contents stacked on top of the box. It is important to note that the higher boxes can be stacked without risking box failure, the greater the savings in storage costs, as less floor space is needed for storage. There is therefore a need for a box which uses relatively thin wall construction material yet incorporates reinforcement structures in the corners thereof to permit the stacking of multiple boxes.

Therefore, an object of the present invention is to provide an improved box having gusseted corners.

Another object of the present invention is to provide a box having gusseted corners which includes upright gusset structures formed in each of the corners of the box, the gusset structures being formed during the assembly of the box from the flat blank to the finished box structure.

Another object of the present invention is to provide a box having gusseted corners which is constructed of thinner wall construction paper product than that used with similar size and type boxes found in the industry.

Another object of the present invention is to provide a box having gusseted corners which can be stacked with product therein to a greater height than that permitted by using prior art boxes.

Another object of the present invention is to provide a box having gusseted corners which quickly and easily folds from a generally flat transport position to the folded assembled position.

Finally, an object of the present invention is to provide a box having gusseted corners which is relatively simple to manufacture and which is safe and durable in use.

SUMMARY OF THE INVENTION

The present invention provides a box with gusseted corners which includes a plurality of walls each connected to and extending generally upright from a base wall thereby forming the box. A plurality of corner gussets each extend between and strengthen adjacent ones of the walls. Each of the corner gussets include a gusset corner formation wall section foldably connected to and extending from one of the walls, and the gusset corner formation wall section has a first fold extending generally parallel with the foldable connection to the wall, the first fold dividing the gusset corner formation wall section into an upper portion and a lower portion. The lower portion extends generally perpendicular from the wall and the upper portion is angled towards the wall wherein the upper and lower portions of the gusset corner formation wall section form an acute angle therebetween. The upper portion of the gusset corner formation wall section further includes a glue flap section adapted for adhesive connection to the wall such that the upper portion and the lower portion of the gusset corner formation wall section cooperate with the wall to form one of the corner gussets.

The box as thus described clearly offers several advantages over those devices found in the prior art. The relatively simple design and easy assembly of the present invention permits the box to be shipped to the end user in unassembled form, thus presenting a great savings in shipping costs. Also, because the box is constructed of thinner wall material than similar boxes currently on the market, the production costs of the box are substantially reduced. Furthermore, because the box includes gusseted corner construction, a plurality of boxes can be stacked with product therein to a greater height than that permitted by using prior art boxes. The present invention thus provides a substantial improvement over those devices found in the prior art.

DESCRIPTION OF THE PREFERRED EMBODIMENT

The box with gusseted corners 10 of the present invention is shown best in FIGS. 1–4*b* as being constructed from a single flat blank 12 which, when assembled, forms the box with gusseted corners 10. In the preferred embodiment, flat blank 12 would be placed on a feed conveyor (not shown) and be fed into the gusset construction section of the box assembly line. As shown best in FIGS. 1 and 2, the gusset assembly section 30 would include a pair of rotatably mounted kicker wheels 32*a* and 32*b* which are mounted adjacent to and parallel with the direction of travel of the blank 12, the kicker wheels 32*a* and 32*b* operative to deform the gusset corner formation sections 14*a*, 14*b*, 14*c*, 14*d* of the blank 12 upwards to a generally upright position as shown best in FIG. 2. As the blank 12 is moved forwards on the conveyer belt, the kicker wheels 32*a* and 32*b* alternatively rotate to move kicker plates 33*a* and 33*b* into forming position wherein the gusset corner formation sections 14*a*–*d* are tilted upwards to a generally upright position, as shown best in FIG. 2. As each kicker wheel 32*a* and 32*b* rotates, the kicker plate 33*a* and 33*b* associated therewith is pivoted into a bending position or is pivoted downwards to disengage from the blank 12, thereby only deforming those sections of the flat blank 12 which should be pivoted upwards.

As the blank 12 continues to be moved forward by the conveyor system, the now upwardly extending gusset corner formation sections 14*a*–*d* each encounter in turn the forming blades 34*a* and 34*b*, depending on the side of the blank 12 on which the gusset corner formation sections 14*a*–*d* are positioned. As shown best in FIGS. 2, 4*a* and 4*b*, each forming blade 34*a* and 34*b* is designed to engage and fold the gusset corner formation section 14*a*–*d* on its respective side.

As each gusset corner formation section 14*a*–*d* is pivoted into generally upright position, slots 35*a* and 35*b* engage the gusset corner formation section 14*a*–*d* adjacent the lower portions thereof to prevent improper bending of the gusset corner during the formation process. In the preferred embodiment shown best in FIGS. 4*a* and 4*b*, slots 35*a* and 35*b* would consist of pairs of generally parallel spaced plates between which the gusset corner formation sections 14*a*–*d* slide. As the flat blank 12 is moved forward on the conveyer belt, each gusset corner formation section 14*a*–*d* encounters one of the forming blades 34*a* and 34*b*. As each of the forming blades 34*a* and 34*b* are designed and operate in substantially similar manners, the following description of forming blade 34*a* should be understood to apply equally to forming blade 34*b*.

Figure 1:
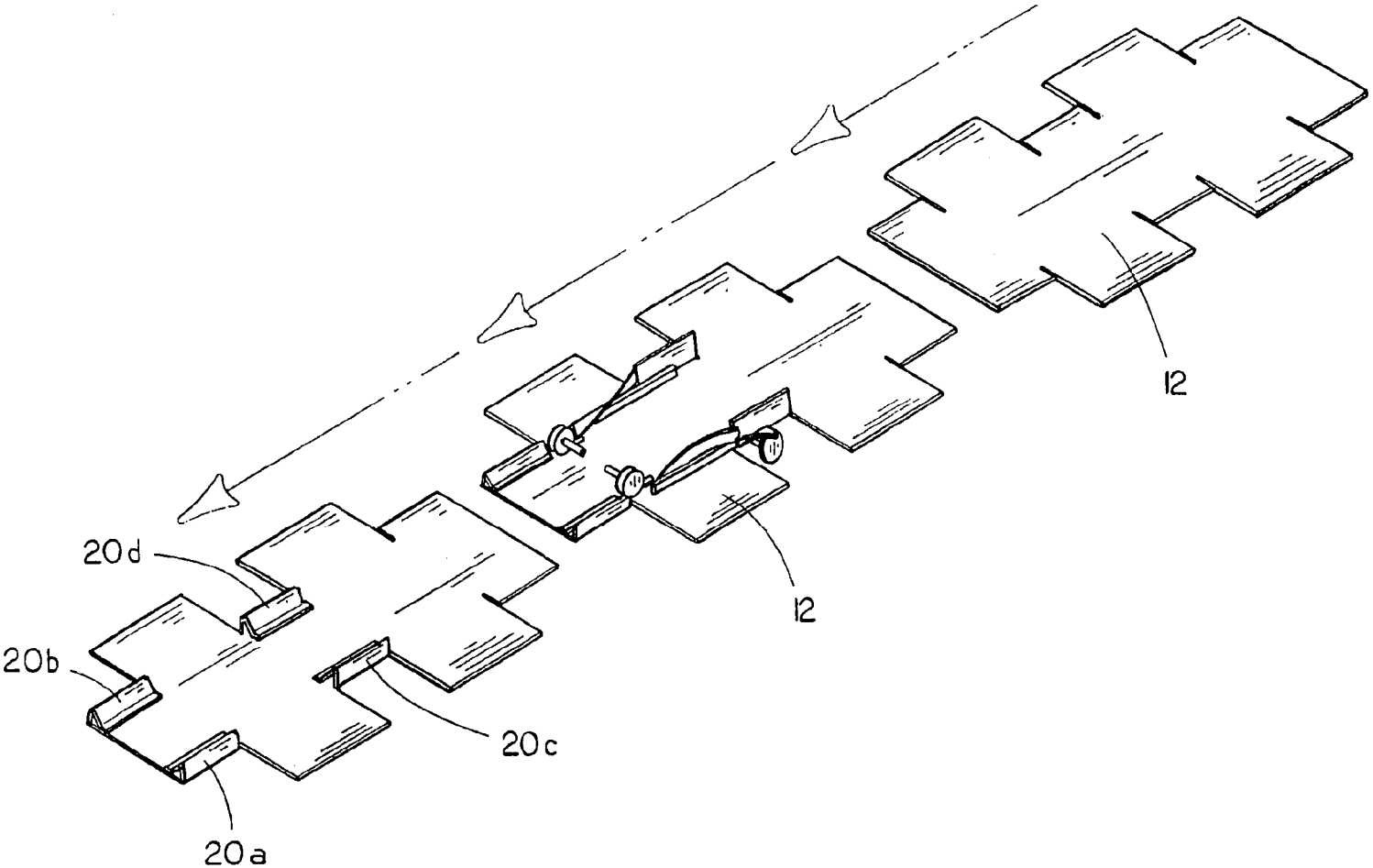
FIG. 1 is a perspective view of the formation method of the present invention showing the formation of the gusseted corners from the generally flat blank prior to assembly.
Figure 2:
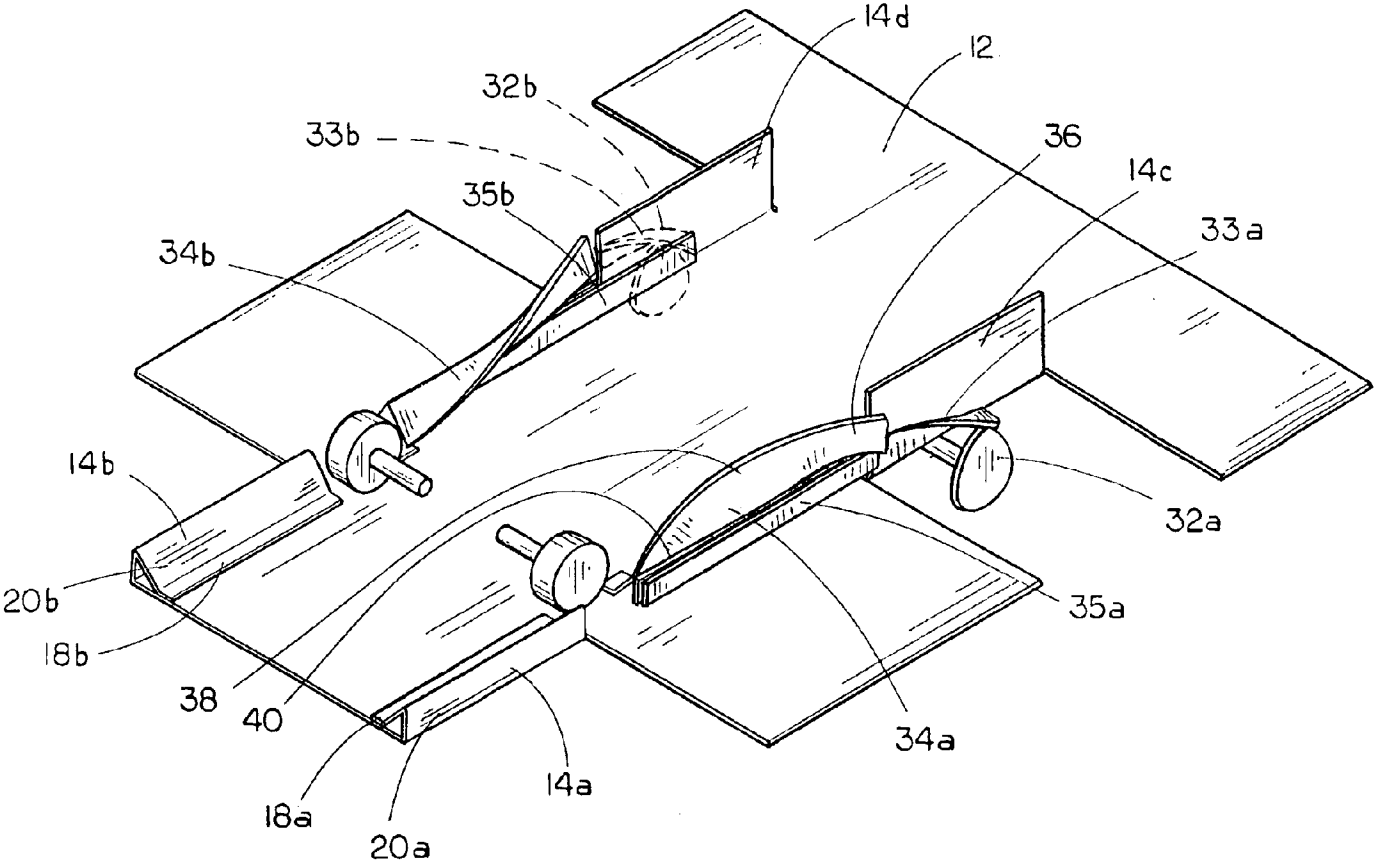
FIG. 2 is a detail perspective view of the assembly method of the present invention.
Figure 3A:
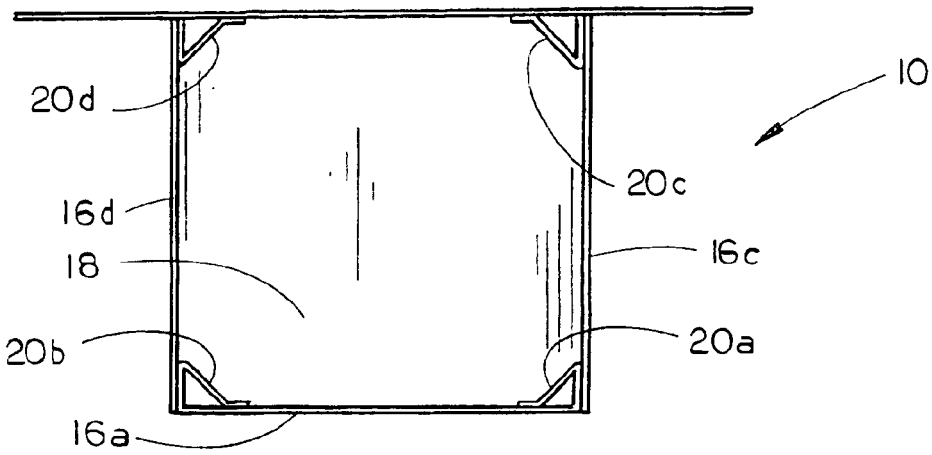
FIGS. 3*a* and 3*b* are, respectively, top plan and perspective views of the assembled box exhibiting the corner gussets formed therein.
Figure 3B:
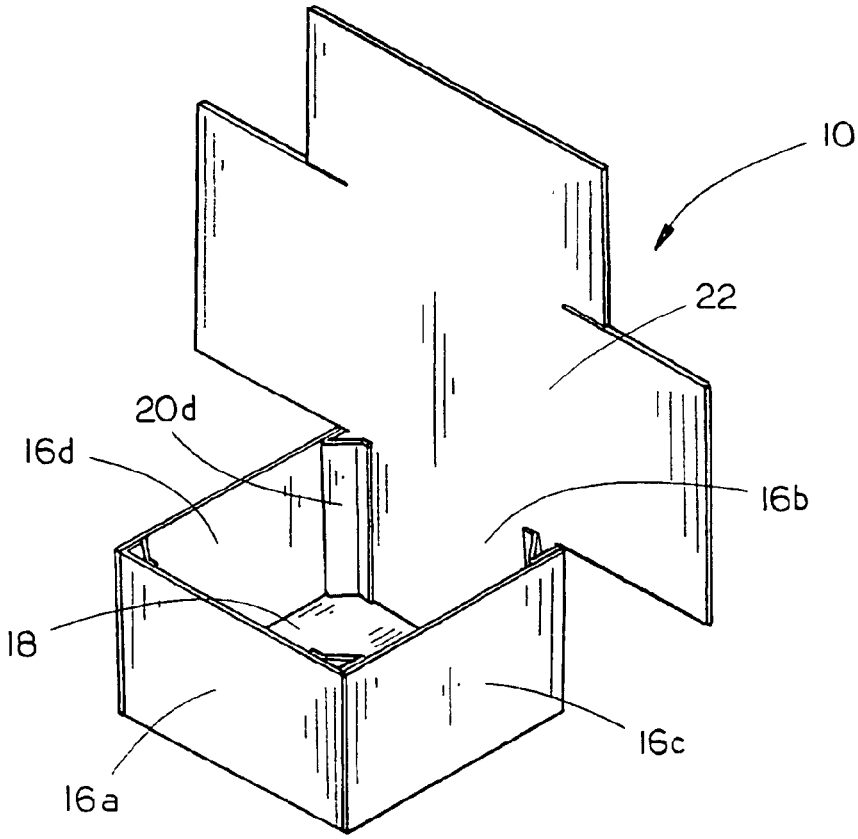
Figure 4A:
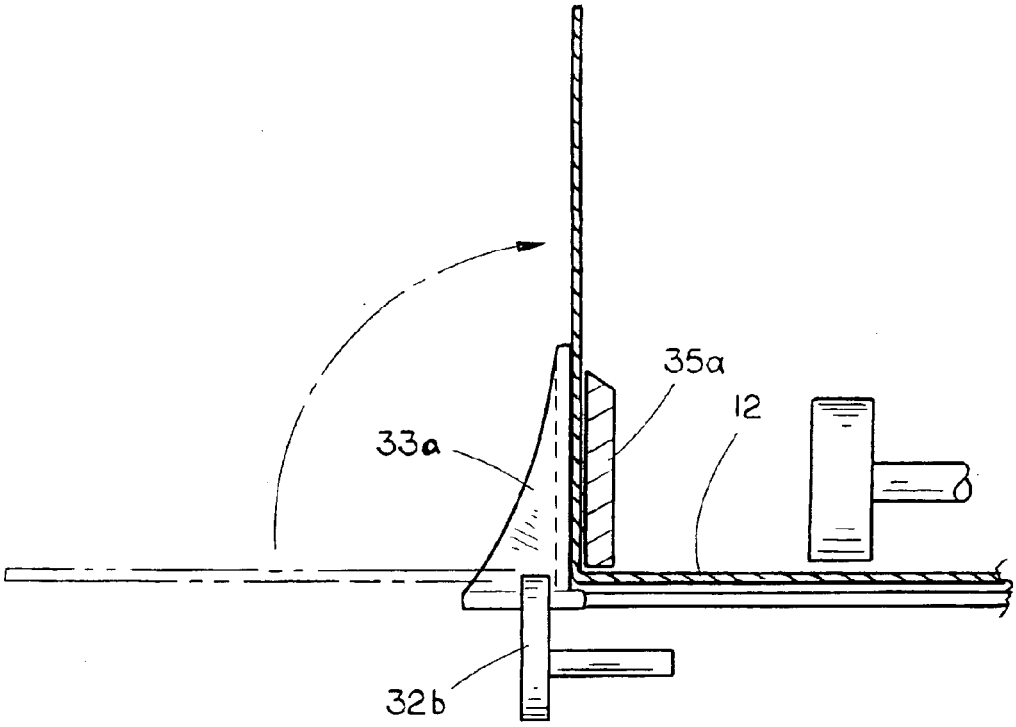
FIGS. 4*a* and 4*b* are detail rear elevational views of the bending and forming stages of the box formation method of the present invention.
Figure 4B:
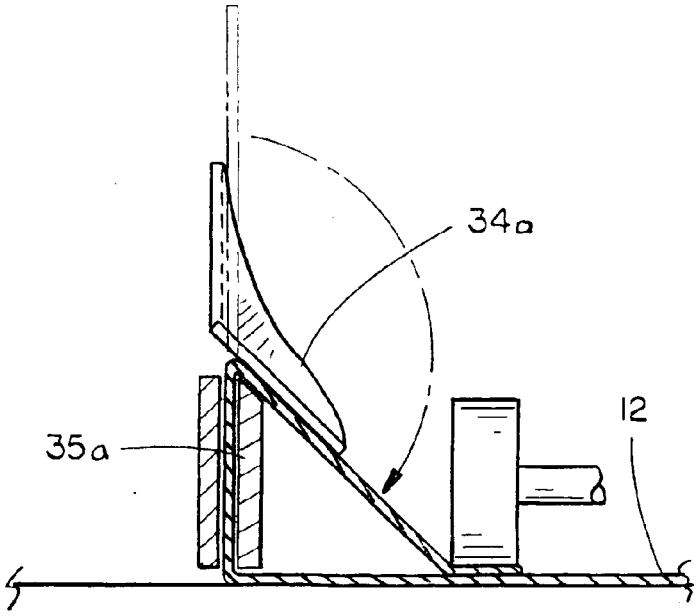

In the preferred embodiment, and as best shown in FIGS. 4*a* and 4*b*, forming blade 34*a* would include a forwardly extending curved engagement section 36 which curves outwards to engage the outer face of the gusset corner formation section 14*c* as it approaches. The forming blade 34*a* further includes a center curved deforming section 38 which acts to bend the upper portion of the gusset corner formation section 14*c* downwards. Because the lower portion of the gusset corner formation section 14*c* is held within the slot 35*a*, only the upper portion of the gusset corner formation section 14*c* is bent downwards along a line defined by the top of the slot 35*a*. Finally, as the blank 12 continues to move forward on the conveyor, the gusset corner formation section 14*c* continues to be engaged by the forming blade 34*a*, in particular the rear section 40 of forming blade 34*a* which presses the formed gusset onto the side wall 16*b* to which the gusset corner formation section 14*c* is attached. This completes the folding formation of the gusset.

The recently formed gussets 20*a* and 20*b* are now engaged by a pair of glue compression rollers 42*a* and 42*b* which each engage a respective glue flap 18*a* and 18*b* of the gussets 20*a* and 20*b*, securing the glue flap 18*a* and 18*b* to the side wall 16*a* on blank 12. Upon drying of the glue, the gussets 20*a* and 20*b* are now formed and the assembly of the box 10 can continue, with the final assembled shape of the box including the four corner gussets 20*a*–*d* as shown best in FIGS. 3*a* and 3*b*.

The box 10 itself when constructed would include side walls 16*a*, 16*b*, 16*c* and 16*d*, base wall 18, gussets 20*a*–*d* and lid 22 and would preferably be constructed of cardboard or the like, depending on the desired performance characteristics. The inventive characteristic of the box 10, however, are the gussets 20*a*–*d* which permit the stacking of more boxes on top of one another than is permitted by the prior art. As the gussets 20*a*–*d* are formed integrally with the rest of the box, the gussets 20*a*–*d* are likely stronger than gussets found in the prior art. Furthermore, the relatively simple construction of the gussets 20*a*–*d* means that they will perform their intended task with less likelihood of failure.

When compared to the prior art, the method of the present invention is far superior as the box 10 is constructed from a single flat blank and can thus be assembled either at the box manufacturer or at the customer's plant location. Furthermore, the manufacturing and assembly process is relatively simple compared to those processes found in the prior art, thus decreasing the manufacturing time and cost for the box 10 of the present invention.

It is to be understood that numerous modifications, additions, and substitutions may be made to the box with gusseted corners 10 of the present invention which fall within the intended broad scope of the preceding description. For example, although the construction materials of the box with gusseted corners 10 is preferred to be a heavy-gauge paper or the like, numerous other types of construction materials may be substituted which fulfill the intended functional characteristics of the box. Also, the precise size, shape and dimensions of the box with gusseted corners 10 of the present invention may be modified and/or changed so long as the functional characteristics are not modified and or destroyed. Finally, the precise angle of the gusset structures 20*a*–*d* may be modified or changed, along with the precise method of manufacture, so long as the support function of each of the gussets 20*a*–*d* is maintained.

There has therefore been shown and described a box with gusseted corners and method of forming same which accomplishes at least all of its intended objectives.

I claim:

1. A method of forming a box having a plurality of corner gussets comprising the steps:

providing a generally planar box blank having a base wall, four side walls and four gusset corner formation wall sections each having upper and lower portions, said four gusset corner formation wall sections extending from and connected to two of said side walls opposite one another with two of said four gusset corner wall sections connected to and extending from each of said two of said side walls;

providing a box forming device including a longitudinally extended box blank track means operative to continually feed said box blank through said box forming device generally free of stoppage of said box blank while in said gusset formation section and further including a gusset formation section having at least one kicker plate, at least one forming blade and at least one adhesive securement means;

feeding said box blank into said box forming device on said box blank track means;

deflecting each of said gusset corner formation wall sections to a generally perpendicular orientation relative to said base wall via said at least one kicker plate;

bending said upper portion of each of said gusset corner formation wall sections towards a connected one of said side walls via said at least one forming blade such that said upper and lower portions of said gusset corner formation wall section form an acute angle therebetween;

securing a glue flap section of said upper portion of each of said gusset corner formation wall sections to said connected one of said side walls via said at least one adhesive securement means thereby securing said upper and lower portions of said gusset corner formation wall section to form a gusset;

folding said side walls upwards generally perpendicular to said base wall;

securing adjacent ones of said side walls to one another whereby said box is formed.

2. A method of forming a box having a plurality of corner gussets comprising the steps.

providing a generally planar box blank having a base wall, four side walls and four gusset corner formation wall sections each having upper and lower portions, said four gusset corner formation wall sections extending from and connected to two of said side walls opposite one another with two of said four gusset corner wall sections connected to and extending from each of said two of said side walls;

providing a box forming device including a gusset formation section having a longitudinally extended box blank track means operative to continually feed said box blank through said box forming device free of stoppage of said box blank while in said gusset formation section;

said gusset formation section further comprising at least two kicker plates, at least two forming blades and at least two adhesive securement means wherein at least one of said at least two kicker plates, said at least two forming blades and said at least two adhesive securement means are positioned on opposite sides of said box blank track means for engaging and manipulating opposite sides of said box blank;

feeding said box blank into said box forming device on said box blank track means;

deflecting each of said gusset corner formation wall sections on opposite sides of said box blank to a generally perpendicular orientation relative to said base wall via said at least two kicker plates;

bending said upper portion of each of said gusset corner formation wall sections on opposite sides of said box blank towards a connected one of said side walls via said at least two forming blades such that said upper and lower portions of said gusset corner formation wall sections form an acute angle therebetween;

securing a glue flap section of said upper portion of each of said gusset corner formation wall sections on opposite sides of said box blank to said connected one of said side walls via said at least two adhesive securement means thereby securing said upper and lower portions of said gusset corner formation wall section to form a gusset;

folding said side walls upwards generally perpendicular to said base wall;

securing adjacent ones of said side walls to one another whereby said box is formed.

3. In combination:

a generally planar box blank having a base wall, four side walls and four gusset corner formation wall sections each having upper and lower portions, said four gusset corner formation wall sections extending from and connected to two of said side walls opposite one another with two of said four gusset corner wall sections connected to and extending from each of said two of said side walls; and a box forming device having a longitudinally extended box blank track means operative to continually feed said box blank through said box forming device generally free of stoppage of said box blank while in said gusset formation section and further including a gusset formation section having at least one kicker plate, at least one forming blade, at least one slot generally adjacent said at least one forming blade for receiving said lower portion of said gusset corner formation wall section and at least one adhesive securement means;

said box forming device operative to engage said box blank with said at least one kicker plate engaging one of said gusset corner formation wall sections and bending said one of said gusset corner formation wall sections generally perpendicular with said base wall;

said at least one slot operative to receive said lower portion of said one of said gusset corner formation wall section and restrict bending thereof;

said at least one forming blade operative to engage said upper portion of said one of said gusset corner formation wall section and bend said upper portion relative to said lower portion such that said upper and lower portions of said gusset corner formation wall section form an acute angle therebetween;

said at least one adhesive securement means operative to secure a glue flap section of said upper portion of said one of said gusset corner formation wall sections to a connected one of said side walls thereby securing said upper and lower portions of said gusset corner formation wall section to form a gusset; and said at least one kicker plate, at least one forming blade, at least one slot cooperating to form gussets with each of said gusset corner formation wall sections.

4. The combination of claim 3 wherein said at least one forming blade comprises a forwardly extending curved engagement section curved to engage an outer face of said gusset corner formation wall sections, a center curved deforming section operative to bend said upper portion of said gusset corner formation wall section and a rear section operative to press the formed gusset onto one of said side walls to which said gusset corner formation wall section is connected.

5. The combination of claim 3 wherein said at least one adhesive securement means comprises a pair of glue compression rollers operative to engage a respective glue flap section of said upper section of said gusset corner formation wall section to secure said glue flap section to the connected side wall to complete formation of the corner gusset.

6. The combination of claim 3 further comprising at least one kicker wheel mounted adjacent said at least one kicker plate, said kicker wheel operative to alternatively engage and disengage said at least one kicker plate to move said at least one kicker plate between a bending position and a disengaged position, thereby only bending said gusset corner formation wall sections of said box blank into a generally perpendicular orientation relative to said base wall and permitting other sections of said box blank to pass free of engagement.

* * * * *